US010071387B2

(12) United States Patent
Ikeda

(10) Patent No.: US 10,071,387 B2
(45) Date of Patent: Sep. 11, 2018

(54) APPARATUS AND METHOD FOR COATING OBJECT BY SUPPLYING DROPLET TO SURFACE OF THE OBJECT WHILE APPLYING ACTIVE SPECIES TO THE DROPLET

(75) Inventor: Yuji Ikeda, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 0 days.

(21) Appl. No.: 13/602,977

(22) Filed: Sep. 4, 2012

(65) Prior Publication Data

US 2013/0004673 A1 Jan. 3, 2013

Related U.S. Application Data

(63) Continuation of application No. PCT/JP2011/054979, filed on Mar. 3, 2011.

(30) Foreign Application Priority Data

Mar. 4, 2010 (JP) ..... 2010-068841
Mar. 4, 2010 (JP) ..... 2010-068842

(51) Int. Cl.
*B05B 7/22* (2006.01)
*B05B 5/053* (2006.01)
(Continued)

(52) U.S. Cl.
CPC ..... *B05B 7/228* (2013.01); *B05B 5/0533* (2013.01); *H05H 1/46* (2013.01); *B05B 7/205* (2013.01);
(Continued)

(58) Field of Classification Search
CPC ..... C23C 16/483; C23C 14/457; B05D 3/06; B05D 3/61; B05D 1/06; B05D 1/12;
(Continued)

(56) References Cited

U.S. PATENT DOCUMENTS 3,179,784 A * 4/1965 Johnson ..... 219/76.16
4,050,408 A * 9/1977 Beucherie ..... 118/723 VE
(Continued)

FOREIGN PATENT DOCUMENTS

JP 03-075856 3/1991
JP 08-229447 A 9/1996
(Continued)

OTHER PUBLICATIONS

International Search Report of PCT/JP2011/054979, dated Jun. 14, 2011.

*Primary Examiner* — Karl Kurple
(74) *Attorney, Agent, or Firm* — Westerman, Hattori, Daniels & Adrian, LLP

(57) ABSTRACT

A coat forming apparatus 100 includes a droplet supply unit 110 and an active species supply unit 120. The droplet supply unit 110 is adapted to spray or drop a droplet for coat forming toward an object 116. The active species supply unit 120 is adapted to supply an active species to be brought into contact with the droplet moving from the droplet supply unit 110 toward the object 116. The coating is formed on a surface of the object 116 by the droplet that has been brought into contact with the active species.

3 Claims, 5 Drawing Sheets

(51) Int. Cl.

| | |
|---|---|
| ***H05H 1/46*** | (2006.01) |
| *B05C 17/005* | (2006.01) |
| *B05C 11/10* | (2006.01) |
| *B05B 12/08* | (2006.01) |
| *B05C 9/14* | (2006.01) |
| *B05B 7/20* | (2006.01) |
| *B05B 13/02* | (2006.01) |
| *B05D 1/02* | (2006.01) |
| *H05H 1/52* | (2006.01) |
| *B05D 3/14* | (2006.01) |

(52) U.S. Cl.
CPC ..... *B05B 12/084* (2013.01); *B05B 13/0228* (2013.01); *B05C 9/14* (2013.01); *B05C 11/1005* (2013.01); *B05C 17/00546* (2013.01); *B05D 1/02* (2013.01); *B05D 3/141* (2013.01); *H05H 1/52* (2013.01); *H05H 2001/463* (2013.01); *H05H 2245/123* (2013.01)

(58) Field of Classification Search
CPC ..... B01J 19/08; B22F 1/0018; B82Y 30/00; H05H 1/42
USPC ..... 427/535, 569; 442/76, 135; 156/345.34, 156/345.47; 118/723 R
See application file for complete search history.

(56) References Cited

U.S. PATENT DOCUMENTS 4,958,058 A * 9/1990 Scheidt et al. ..... 219/121.6
4,991,541 A * 2/1991 Sugata et al. ..... 118/716
5,356,674 A * 10/1994 Henne et al. ..... 427/449
5,358,596 A * 10/1994 Cappelli et al. ..... 117/99
5,413,821 A * 5/1995 Ellis et al. ..... 427/576
5,616,368 A * 4/1997 Jin et al. ..... 427/535
5,647,543 A 7/1997 Ma
5,906,757 A * 5/1999 Kong ..... H05H 1/42 219/121.36
5,939,151 A * 8/1999 Prichard et al. ..... 427/576
6,073,578 A * 6/2000 Shim ..... C23C 14/0026 118/723 I
6,213,049 B1 * 4/2001 Yang ..... 118/723 R
6,277,448 B2 * 8/2001 Strutt et al. ..... 427/452
6,280,802 B1 * 8/2001 Akedo et al. ..... 427/561
6,447,848 B1 * 9/2002 Chow et al. ..... 427/446
6,827,634 B2 * 12/2004 Akedo ..... 451/54
7,112,758 B2 * 9/2006 Ma et al. ..... 219/121.47
7,619,216 B1 * 11/2009 Whitehouse et al. ..... 250/288
7,964,247 B2 * 6/2011 Boulos et al. ..... 427/446
8,053,254 B2 * 11/2011 Tsuda et al. ..... 438/5
8,080,278 B2 * 12/2011 Jabado et al. ..... 427/201
8,166,912 B2 * 5/2012 Ko ..... B05B 5/032 118/308
8,337,957 B2 * 12/2012 Simor et al. ..... 427/488
8,338,317 B2 * 12/2012 Engelhardt et al. ..... 438/798
8,443,754 B2 * 5/2013 Yamada ..... B05B 5/0535 118/323
2003/0077398 A1 * 4/2003 Strutt et al. ..... 427/452
2004/0152381 A1 * 8/2004 York et al. ..... 442/76
2006/0134347 A1 * 6/2006 Chiruvolu et al. ..... 427/585
2007/0017636 A1 1/2007 Goto et al.
2007/0031606 A1 * 2/2007 Miyazawa ..... B05B 7/0846 427/421.1
2007/0160840 A1 * 7/2007 Park et al. ..... 428/407
2008/0090071 A1 4/2008 Valle et al.
2009/0071371 A1 * 3/2009 Theodore et al. ..... 106/287.11
2009/0229753 A1 9/2009 Ohmi et al.
2009/0288601 A1 * 11/2009 Bi et al. ..... 118/722
2009/0311442 A1 * 12/2009 Legein et al. ..... 427/569
2010/0024974 A1 * 2/2010 Narita ..... 156/275.5
2010/0048076 A1 * 2/2010 Creyghton et al. ..... 442/135
2010/0237048 A1 * 9/2010 Brothier ..... F23G 5/085 219/121.5
2010/0304045 A1 * 12/2010 Bisges ..... 427/569
2011/0008025 A1 * 1/2011 Lee ..... H05H 1/42 392/307
2011/0039036 A1 * 2/2011 Reichen ..... H05H 1/42 427/569
2011/0121107 A1 * 5/2011 Siffer ..... B05D 1/62 239/589
2011/0121108 A1 * 5/2011 Rodewald ..... B05B 7/22 239/589
2011/0200822 A1 * 8/2011 Detavernier et al. ..... 428/402
2012/0006262 A1 * 1/2012 Tsuda et al. ..... 118/699
2012/0261389 A1 * 10/2012 Lin et al. ..... 219/121.46
2013/0136940 A1 * 5/2013 Lin et al. ..... 428/544
2014/0087084 A1 * 3/2014 Nettesheim ..... B05B 7/226 427/446
2014/0273518 A1 * 9/2014 Rogers ..... C23C 16/52 438/776
2015/0086725 A1 * 3/2015 VanEvery ..... B08B 3/026 427/446

FOREIGN PATENT DOCUMENTS

JP 10-057848 A 3/1998
JP 2002-219385 A 8/2002
JP 2004-356558 A 12/2004
JP 2008-517159 A 5/2008
JP 2009-218517 A 9/2009

* cited by examiner

APPARATUS AND METHOD FOR COATING OBJECT BY SUPPLYING DROPLET TO SURFACE OF THE OBJECT WHILE APPLYING ACTIVE SPECIES TO THE DROPLET

TECHNICAL FIELD

The present invention relates to a coat forming apparatus that forms a coating such as a paint coating on a surface of an object.

BACKGROUND ART

Conventionally, there is known a coat forming apparatus that forms a coating on a surface of an object. As the coat forming apparatus, there are provided a painting apparatus for painting a surface of an object and a coating apparatus for forming a protective layer, and the like, on the surface of the object.

Patent document 1 discloses an electrostatic coating apparatus. The electrostatic coating apparatus can reduce electrically-charged particles adhered to the electrostatic coating apparatus itself or the surrounding of the electrostatic coating apparatus. Patent document 2 discloses a rotary atomizing coating apparatus. The rotary atomizing coating apparatus causes coating material to be electrostatically adsorbed on an object to be coated in accordance with a potential difference between a rotary atomizing head and the object to be coated.

PRIOR ART DOCUMENT

Patent Document

Patent Document 1: Japanese Unexamined Patent Application, Publication No. H10-57848

Patent Document 2: Japanese Unexamined Utility Model Registration Application, Publication No. H03-75856

THE DISCLOSURE OF THE INVENTION

Problems to be Solved by the Invention

Meanwhile, the coat forming apparatus of this kind is expected to improve adhesive property of the droplets to the surface of the object. However, in order to improve the adhesive property of the droplets, the coating apparatus is required to spray a large amount of coating material, since droplets of coating material are partly rebounded by the object, resulting in the fact that relatively large number of droplets of coating material do not contribute to the coating.

The present invention has been made in view of the above described drawbacks, and it is an object of the present invention to improve the adhesive property of droplets on a surface of an object in the coat forming apparatus that forms a coating on the surface of the object.

Means for Solving the Problems

In accordance with a first aspect of the present invention, there is provided a coat forming apparatus, comprising: a droplet supply unit that sprays or drops a droplet for coat forming toward an object; and an active species supply unit that supplies an active species to be brought into contact with the droplet moving from the droplet supply unit toward the object; wherein the coating is formed on a surface of the object by the droplet that has been brought into contact with the species.

According to the first aspect of the present invention, the active species is brought into contact with the droplet moving toward the object. Then, the surface of the droplet is changed in chemical composition, and the surface tension and viscosity of the droplet are reduced. This means that the surface of the droplet is reformed. Thus, the droplet having reduced surface tension and viscosity is adhered to the object and the droplet becomes a part of a coating.

In accordance with a second aspect of the present invention, in addition to the feature of the first aspect of the present invention, the aforementioned active species supply unit includes a first supply part that supplies an active species to be brought into contact with the droplet moving from the droplet supply unit toward the object, and a second supply part that causes an active species to be brought into contact with a surface of the object before the droplet that has been contacted with the active species is adhered to the object.

According to the second aspect of the present invention, the first supply part reduces the surface tension and the viscosity of the droplet before the droplet is adhered to the object. On the other hand, the second supply part causes the active species to be brought into contact with the surface of the object before the droplet is adhered to the object, thereby improving hydrophilic property of the surface of the object. According to the second aspect of the present invention, the droplet having reduced surface tension and viscosity by the active species is adhered to the surface of the object improved in hydrophilic property by the active species.

In accordance with a third aspect of the present invention, in addition to the feature of the second or third aspect of the present invention, the active species supply unit is adapted to generate a plasma and cause an active species generated by the plasma to be brought into contact with the droplet.

According to the third aspect of the present invention, the active species operative to reduce the surface tension and viscosity of the droplet is generated by the plasma.

In accordance with a fourth aspect of the present invention, in addition to the feature of the third aspect of the present invention, the active species supply unit is adapted to generate a plasma outside of a moving path along which the droplet moves from the droplet supply unit toward the object, and gas containing an active species generated by the plasma is supplied to the moving path.

According to the fourth aspect of the present invention, since the plasma is generated outside of the moving path, the droplet on the moving path is not brought into contact with the plasma.

In accordance with a fifth aspect of the present invention, in addition to the feature of the fourth aspect of the present invention, the coat forming apparatus further comprises a compartment member having a plasma generating chamber formed therein, in which the active species supply unit generates plasma, and the compartment member is formed with an outlet designed to blow the gas containing the active species to be supplied to the moving path from the plasma generating chamber.

According to the fifth aspect of the present invention, the plasma is generated in the plasma generating chamber formed in the compartment member. The gas containing the active species generated by the plasma is blown to the moving path through the outlet of the compartment member.

In accordance with a sixth aspect of the present invention, in addition to the feature of the fifth aspect of the present invention, the coat forming apparatus further comprises a penetration prevention unit that prevents a droplet moving toward the object from penetrating into the plasma generating chamber through the outlet.

According to the sixth aspect of the present invention, the droplet is prevented from penetrating into the plasma generating chamber by the penetration prevention unit.

In accordance with a seventh aspect of the present invention, in addition to the feature of any one of the first to sixth aspects of the present invention, the droplet supply unit is adapted to spray a droplet toward the object, and the active species supply unit is adapted to atomize the droplet sprayed from the droplet supply unit by causing the droplet to be brought into contact with the active species.

According to the seventh aspect of the present invention, the droplet atomized by the active species is adhered to the surface of the object, and the droplet becomes a coating.

In accordance with an eighth aspect of the present invention, in addition to the feature of the seventh aspect of the present invention, the aforementioned coat forming apparatus further comprises a control unit that controls the size of the droplet after being atomized by the active species, by controlling energy to be inputted per unit time to generate the active species.

According to the eight aspect of the present invention, the size of the droplet after being atomized is controlled, by controlling the energy to be inputted per hour for generation of the active species.

In accordance with a ninth aspect of the present invention, in addition to the feature of any one of the first to eighth aspects of the invention, the droplet sprayed or dropped by the droplet supply unit contains organic solvent, and the active species supply unit includes a first supply part that supplies an active species to be brought into contact with the droplet moving from the droplet supply unit toward the object, and a second supply part that supplies an active species to gas generated from vaporized droplets.

According to the ninth aspect of the present invention, since the droplet contains organic solvent, toxic gas is generated after the droplet is vaporized. The second supply part supplies an active species to the gas generated from vaporized droplet to dissolve the toxic components.

In accordance with a tenth aspect of the present invention, in addition to the feature of the ninth aspect of the present invention, the second supply unit is adapted to supply the active species toward the vicinity of an area adhered with the droplet on the object.

According to the tenth aspect of the present invention, the active species is supplied to the area of high concentration of toxic component.

In accordance with an eleventh aspect of the present invention, in addition to the feature of any of the seventh or eighth aspect of the present invention, the droplet sprayed by the droplet supply unit contains organic solvent, and the active species supply unit includes a first supply part that supplies an active species to be brought into contact with the droplet moving from the droplet supply unit toward the object, and a second supply part that causes the droplet rebounded from the object to be brought into contact with the active species.

According to the eleventh aspect of the present invention, the active species is brought into contact with the droplet rebounded from the object. Accordingly, the organic solvent contained in the droplet is directly dissolved.

In accordance with a twelfth aspect of the present invention, in addition to the feature of any one of the first to sixth aspects of the present invention, the droplet supply unit is adapted to drop a droplet, and form a coating by rotating the object adhered with the droplet, and enlarging the droplet.

According to the twelfth aspect of the present invention, the droplet supply unit drops the droplet of, for example, a coating material. Then, the object adhered with the droplet is rotated. As a result, the droplet is enlarged and a coating is formed.

In accordance with a thirteenth aspect of the present invention, a method of manufacturing a coat forming material is provided. The method includes an adherence step of spraying or dropping a droplet for coat forming toward an object, and causing the droplet moving toward the object to be brought into contact with the active species and to be adhered to the object.

According to the thirteenth aspect of the present invention, the droplet moving toward the object is brought into contact with the active species. Then, the surface of the droplet changes in chemical composition, and reduces in the surface tension and viscosity. Thus, the droplet having reduced surface tension and viscosity adheres to the object and the droplet becomes a part of a coating.

Effects of the Invention

According to the present invention, since a droplet having reduced surface tension and viscosity is caused to adhere to an object, it is possible to improve the adhesive property of the droplets to the surface of the object. As a result thereof, in the case in which a coating apparatus is employed as the coat forming apparatus, since the droplets of coating material not adhering to the object are reduced in amount, the used amount of the coating material can be reduced.

Furthermore, according to the second aspect of the present invention, the droplets having reduced surface tension and viscosity by the active species adhere to the surface of the object improved in hydrophilic property by the active species. Accordingly, it becomes possible to further improve the adhesive property of the droplet to the surface of the object.

Furthermore, according to the fourth aspect of the present invention, since the droplet on the moving path does not contact the plasma, it becomes possible to prevent the droplet from combustion in a case in which flammable substance is contained therein.

Furthermore, according to the sixth aspect of the present invention, since the droplet does not enter in the plasma generating chamber, it becomes possible to unfailingly prevent the droplet from combustion in a case in which flammable substance is contained therein.

Furthermore, according to the seventh aspect of the present invention, since the droplet atomized by the active species adheres to the surface of the object, it becomes possible to improve the coating quality in a case of, for example, coating. In a case in which organic solvent is used to prepare the coating material to be sprayed, it becomes possible to reduce the used amount of the organic solvent to be generated. As a result thereof, it becomes possible to reduce VOC (Volatile Organic Compounds) emission.

Furthermore, according to the eighth aspect of the present invention, since the size of the atomized droplet can be electrically controlled, it is possible to adjust the size of the droplet after being atomized according to the solvent, the object, and the like to be used becomes possible.

Furthermore, according to the tenth aspect of the present invention, since the area of high concentration of toxic component is supplied with the active species, it becomes possible to dissolve the toxic component with high energy efficiency.

Furthermore, according to the eleventh aspect of the present invention, since the droplet rebounded from the object is brought into contact with the active species to directly dissolve the organic solvent, it becomes possible to dissolve the toxic component with high energy efficiency.

BRIEF DESCRIPTION OF THE DRAWINGS

FIG. 5 is a schematic configuration diagram of a coating apparatus according to a second embodiment, wherein FIG. 5A is a schematic configuration diagram of a preprocessing part, FIG. 5B is a schematic configuration diagram of a state of plasma processing on a coating material droplet carried out by a coating part, and FIG. 5C is a schematic configuration diagram of a state in which a rotation table is rotated by a coating part.

BEST MODE FOR CARRYING OUT THE INVENTION

In the following, a detailed description will be given of embodiments of the present invention with reference to drawings.

First Embodiment

Figure 1:
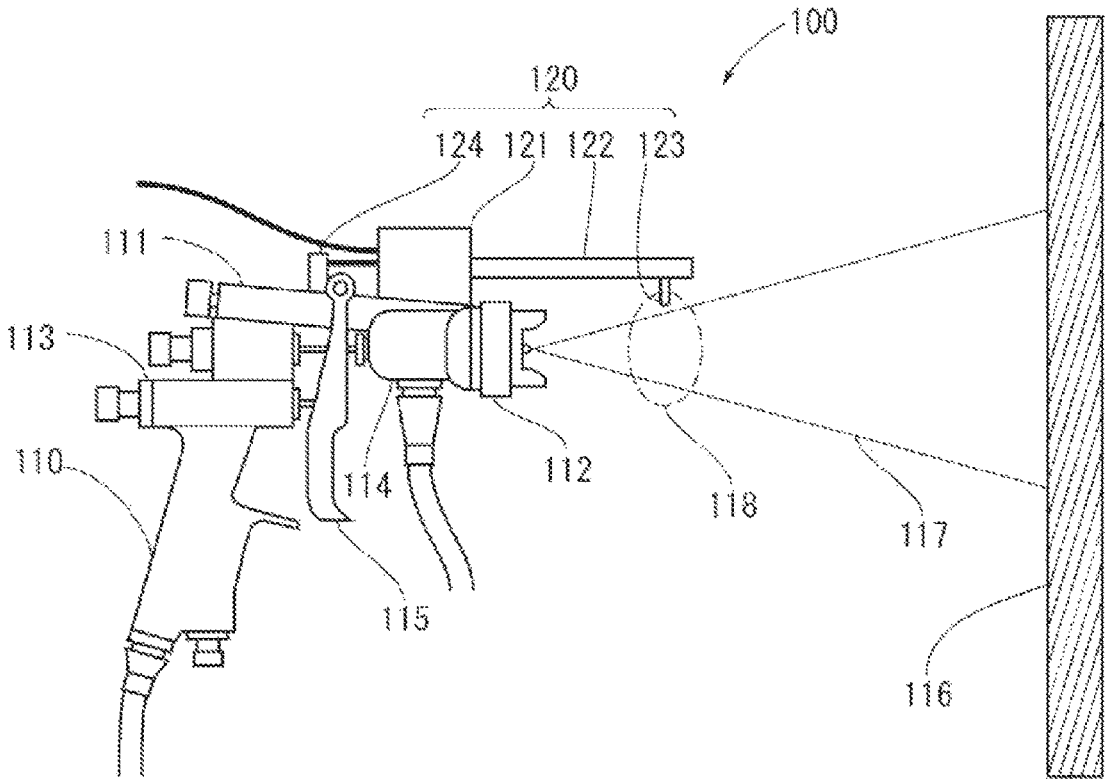
FIG. 1 is a schematic configuration diagram of a coating apparatus according to a first embodiment.

The first embodiment is directed to a coating apparatus 100 configured by a coat forming apparatus 100 according to the present invention. The coating apparatus 100 merely exemplifies one example of the present invention. As shown in FIG. 1, the coating apparatus 100 is provided with a spray gun 110 that sprays liquid coating material for coating a target 116 (object) to be coated, and a plasma generating device 120 attached to the spray gun 110. The liquid coating material includes organic solvent.

The spray gun 110 constitutes a droplet supply unit that sprays a droplet for coat forming toward the target 116. The spray gun 110 is of a commonly-used air atomization type. The spray gun 110 includes a main body 111 in a shape of pistol and a nozzle 112 attached to the main body 111. The inside of the main body 111 is formed with a compressed air flow path (not shown) configured to supply compressed air to a plurality of air spray holes of the nozzle 112, and a coating material flow path (not shown) configured to supply coating material to a coating material spray hole of the nozzle 112. The main body 111 is provided with an air valve 113 configured to open and close the compressed air flow path, and a needle valve 114 configured to open and close the coating material flow path. The air valve 113 and the needle valve 114 maintain the nozzle 112 closed as long as no operation is performed. The needle valve 114 directly drives the nozzle 112 to be open and closed.

The main body 111 is fixed with a trigger 115 that is engaged with the air valve 113 and the needle valve 114. When a user pulls the trigger 115, the force applied to the trigger 115 works and causes the air valve 113 and the needle valve 114 to be open.

The nozzle 112 is provided with the coating material spray hole and the plurality of air spray holes. The coating material spray hole is formed in the vicinity of the center of the nozzle 112. The plurality of air spray holes are formed having the coating material spray hole in between. Each air spray hole is configured to spray out compressed air in such a direction that the compressed air flows from the air spray holes collide with one another at predetermined angles on a center line extending from the center of the nozzle 112 toward the target 116. The compressed air flows collide in the vicinity of the nozzle 112. On the center line of the nozzle 112, the compressed air flows from the air spray holes continuously collide with one another, and the collided air conically spreads outwardly. Due to such compressed air flows, the coating material sprayed from the coating material spray hole is drawn into the compressed air flows to be atomized and spatter toward the target 116 in front within a range 117 in a fan-shape viewing from aside. When the air valve 113 and the needle valve 114 are open, the coating material atomized by the compressed air spatters toward the target 116.

The plasma generating device 120 constitutes the active species supply unit that supplies the active species to be brought into contact with the droplet moving from the spray gun 110 toward the target 116. The plasma generating device 120 generates a plasma, and causes the active species generated by the plasma to be brought into contact with the droplet. In this manner, the plasma generating device 120 functions as an active species generation unit as well as the active species supply unit. The plasma generating device 120 causes the active species generated by the plasma to be brought into contact with the droplet, and, in this way, atomizes the droplet. The plasma generating device 120 is provided with a power supply device 121, an arm 122, a discharge electrode part 123, and an operation switch 124.

The power supply device 121 is installed to the main body 111 of the spray gun 110. The arm 122 extends from the power supply device 121 in a spray direction of the coating material. The discharge electrode part 123 is connected to the arm 122 at an end opposite to the power supply device 121. The operation switch 124 responds to the operation of the trigger 115, and outputs an operation signal to the power supply device 121.

In the present embodiment, the plasma generation device 120 generates a plasma outside of the moving path along which the droplet moves from the spray gun 110 toward the target 116, and supplies to the moving path an active species containing gas that contains the active species generated by the plasma. In the plasma generation device 120, the discharge electrode part 123 is arranged to supply the active species in the vicinity of the nozzle 112 within the spatter range 117 of the droplet. The discharge electrode part 123 is arranged such that a chemical component processed by the plasma generation device 120 may be present on a flow line of the coating material sprayed by the spray gun 110.

Figure 2:
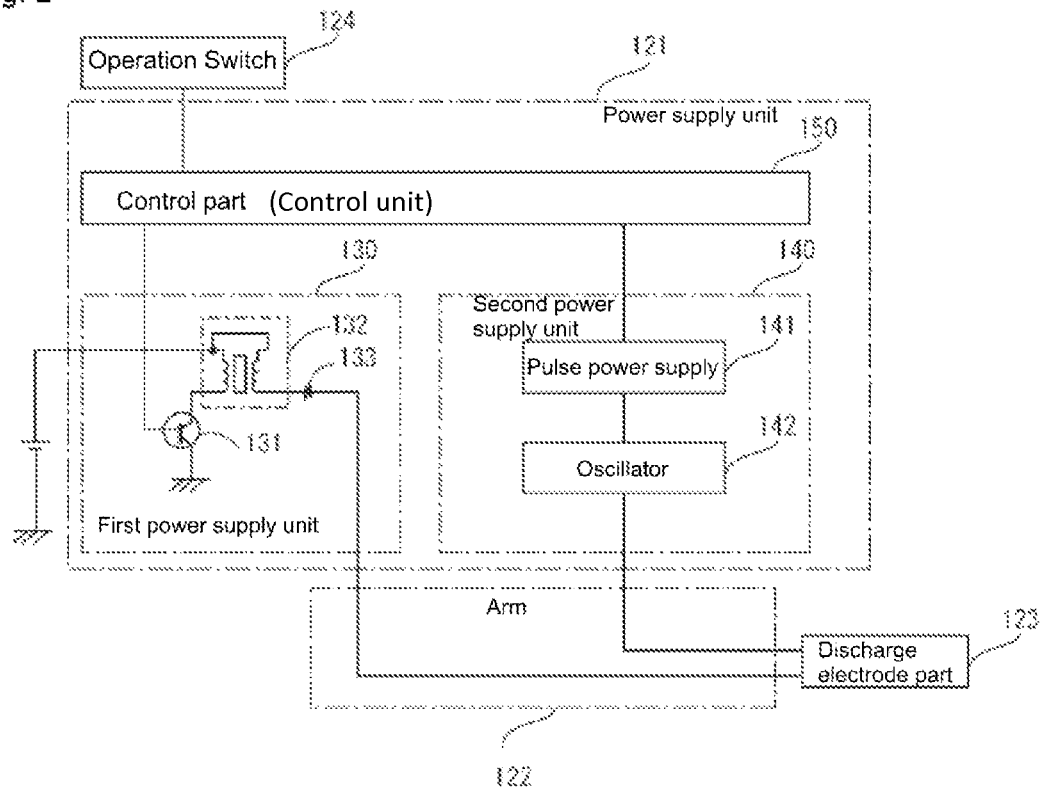
FIG. 2 is a block diagram of a plasma generating device according to the first embodiment.

As shown in FIG. 2, the power supply device 121 includes a first power supply part 130 that applies a DC pulse voltage to the discharge electrode part 123, a second power supply part 140 that supplies an electromagnetic wave to the discharge electrode part 123, and a control unit such as a control part 150 that outputs control signals to the first power supply part 130, the second power supply part 140, and the operation switch 124.

The first power supply part 130 receives a first control signal from the control part 150, and outputs a high voltage pulse. The first power supply part 130 is, for example, an ignition coil used for a spark-ignited internal combustion engine. As shown in FIG. 2, the first power supply part 130 is provided with a boost switch 131, a boost coil 132, and a rectifier 133. The boost switch 131 is composed of an NPN transistor. In the boost switch 131, a base is connected to the control part 150, and an emitter is grounded. In the boost coil 132, terminals of a primary coil are respectively connected to an external DC power supply and a collector of the boost switch 131. The rectifier 133 is connected to a secondary coil of the boost coil 132. In the first power supply part 130, when the first control signal is applied to the base of the boost switch 131, a current flows through the primary coil of the boost coil 132. In the boost coil 132, a magnetic field changes, and energy is stored in the primary coil. If the first control signal ceases to be applied under this situation, the energy flows into the secondary coil of the boost coil 132, and the secondary coil outputs a high voltage pulse to the discharge electrode part 123.

The second power supply part 140 receives a second control signal from the control part 150, and outputs a pulsed electromagnetic wave such as microwave. The second power supply part 140 is provided with a pulse power supply 141 and an oscillator 142. In response to the second control signal outputted from the control part 150, the pulse power supply 141 converts a current applied from an external power supply into a DC pulse. In response to the power supplied from the pulse power supply 141, the oscillator 142 generates an electromagnetic wave of a predetermined frequency. The oscillator 142 is, for example, a magnetron. The oscillator 142 may be a feedback oscillator or may be a relaxation oscillator. The pulse power supply 141 may be selected as appropriate according to the type of the oscillator 142 employed in the present apparatus.

In the second power supply part 140, when the second control signal is applied from the control part 150, the pulse power supply 141 starts power supply to the oscillator 142. The oscillator 142 receives this power and outputs the electromagnetic wave. When the second control signal ceases to be applied, the power supply device 121 terminates the power supply, and the oscillator 142 ceases to output the electromagnetic wave.

The electromagnetic wave oscillation by the second power supply part 140 may be CW (Continuous Wave) oscillation or may be pulsed oscillation in a cycle from 100 nanoseconds to 100 milliseconds or the like. In a case of pulsed oscillation, the cycle of the pulsed electromagnetic wave may be set in advance by a circuit configuration of the second power supply part 140 or may be set as appropriate according to the second control signal from the control part 150.

The control part 150 responds to an operation signal inputted from the operation switch 124, and outputs the control signals to the first power supply part 130 and the second power supply part 140 at a predetermined timing. The first control signal to the first power supply part 130 is a positive logic TTL signal sustaining for a predetermined period. The second control signal to the second power supply part 140 includes a start signal and a termination signal of the operation of the second power supply part 140. The second control signal may include designation signals of output level, frequency, and the like of the second power supply part 140. These designation signals may be employed as appropriate according to the type of the oscillator 142.

Each function of the control part 150 is implemented by a computer hardware, a program executed on the computer hardware, and data readable or writable by the computer hardware. These functions and operations are implemented by a CPU carrying out the program.

The arm 122 incorporates a first transmission path (not shown) configured to supply the high voltage pulse outputted from the first power supply part 130 to the discharge electrode part 123, and a second transmission path (not shown) configured to supply the electromagnetic wave outputted from the second power supply part 140 to the discharge electrode part 123.

Figure 3:
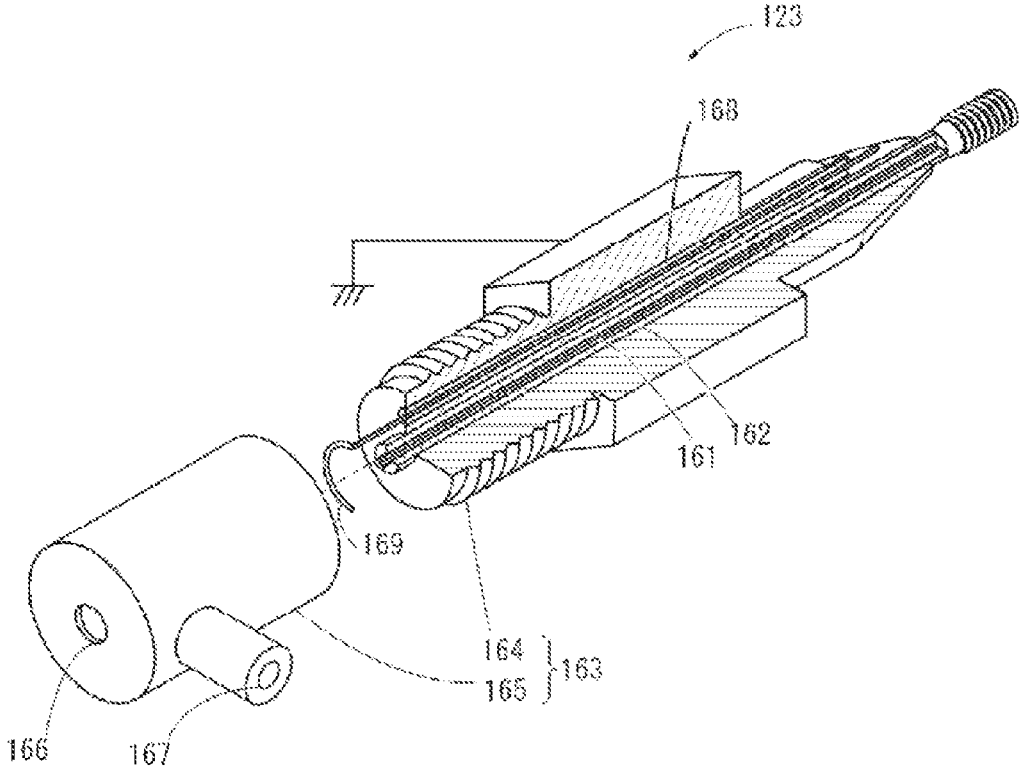
FIG. 3 is a schematic configuration diagram of a discharge electrode part according to the first embodiment.

As shown in FIG. 3, the discharge electrode part 123 is a retrofit of an ignition plug used for a spark-ignited internal combustion engine. The discharge electrode part 123 includes a cathode (center electrode) 161, an insulator 162, and an anode 163.

The cathode 161 is composed of an approximately rod-shaped conductor, one end of which is connected to the first transmission path. The insulator 162 is a tube-shaped insulator, inside of which the cathode 161 is embedded. The anode 163 includes a body 164 and a cap 165, both of which are composed of conductors.

The body 164 is formed in an approximately tube shape, inside of which the insulator 162 is fitted. The cap 165 is formed in an approximately cylindrical shape having one end (tip end) closed by a bottom surface that is formed with an opening 166. The opening 166 functions as an outlet 166 configured to expel to an exterior space an active species containing gas that contains an active species generated in an interior cavity of the cap 165.

The cap 165 constitutes a compartment member internally formed with a plasma generating chamber, in which the discharge electrode part 123 generates plasma, and formed with the outlet 166 for expelling the active species containing gas that is supplied from the plasma generating chamber to the moving path. The cap 165 may be provided with a penetration prevention unit (for example, a mesh member) that prevents a droplet from penetrating into the plasma generating chamber through the outlet 166.

The cap 165 is tapered toward the tip end thereof. In the cap 165, an inner circumference surface of a base end thereof is screwed with an outer circumference surface of the body 164 so as to surround a tip of the cathode 161. In the cap 165, the interior cavity is in communication with the exterior space via the outlet 166 on the bottom surface at the tip end. In the cap 165, an insulation distance with the cathode 161 is shortest in the vicinity of a periphery of the outlet 166. In the cap 165, a surrounding member of the outlet 166 is gradually thinned toward the outlet 166. The cap 165 is provided with an inlet 167 configured to be openable and closable so as to introduce an outside gas into the inner cavity.

The discharge electrode part 123 further includes an electromagnetic wave transmission part 168 that constitutes a part of the second transmission path, and an electromagnetic wave emitter such as an antenna 169 connected to the electromagnetic wave transmission part 168. The electromagnetic wave transmission part 168 is composed of a coaxial line, which penetrates through the body 164. The antenna 169 protrudes from the tip end surface of the body 164 and curves so as to surround the tip of the cathode 161. The antenna 169 is accommodated in the cap 165.

In the discharge electrode part 123, upon receiving a high voltage pulse, a discharge plasma is generated by way of insulation breakdown at a discharge gap between the cathode 161 and the anode 163. While such plasma is present, when the discharge electrode part 123 receives an electromagnetic wave, the electromagnetic wave is radiated in the cap 165 from the antenna 169, and energy of the electromagnetic wave is imparted to a charged particle in the discharge plasma. By receiving the electromagnetic wave energy, the charged particle (especially, a free electron) is accelerated, collides with another substance, and ionizes it. By receiving the electromagnetic wave energy, the ionized charged particle is also accelerated, and ionizes still another substance. This chain reaction expands a region of discharge plasma, and the discharge plasma grows into an electromagnetic wave plasma (microwave plasma) that is relatively large.

When an electromagnetic wave plasma is generated by the plasma generating device 120, an active species such as a radical (e.g., oxygen radical and hydroxyl radical) and a reactive ion is generated. Though the radical and the ion may be recombined with electrons, the resultant molecules also include a reactive chemical component such as ozone.

When the electromagnetic wave radiation from the antenna 169 continues to be radiated under a situation in which the inlet 167 is closed, temperature and pressure inside the cap 165 is raised owing to the electromagnetic wave energy. As a result thereof, a pressure difference is produced between inside and outside of the cap 165, and an active species containing gas that contains active species in the cap 165 sprays out.

In the present embodiment, the size of the cap 165 and the level of electromagnetic wave energy radiated per unit time from the antenna 169 is configured such that the plasma may not be sprayed from the outlet 166 toward outside of the cap 165. As a result thereof, it becomes possible to prevent flammable coating material from being brought into contact with the plasma, and then burned.

In a case in which no flammable material is included in the coating material, the size of the cap 165 and the level of electromagnetic wave energy radiated per unit time from the antenna 169 may be configured such that the plasma as well as the active species may spray out from the outlet 166. A spray amount, a spray time, and a temperature of the plasma are adjustable by changing the level of the electromagnetic wave energy radiated per unit time from the antenna 169. This means that a shape of a region of gas processed by the plasma is adjustable according to shapes of the cap 165 and the surrounding member of the outlet 166. Likewise, an extent, a timing, a scale, and the like of action on the coating material droplet are adjustable.

The control part 150 may control the size of the droplet after being atomized by the active species, by controlling the level of electromagnetic wave energy to be inputted per unit time by the plasma generating device 120 to generate the active species. In this case, the level of electromagnetic wave energy to be inputted per unit time to generate the active species is controlled in accordance with, for example, a target value of the average size of particle after being atomized.

Operation of Coating Apparatus

The coating apparatus 100 carries out an adherence step of spraying a coating material droplet for coat forming toward the target 116, and causing the coating material droplet moving toward the target 116 to be brought into contact with the active species and to be adhered to the target 116. A coat forming material, on which the coat is formed, is produced by firstly carrying out a shape processing, then the adherence step, a drying step, and the like on the target 116. The adherence step will be described in detail hereinafter.

During the adherence step, when the trigger 115 is pulled, the spray gun 110 sprays coating material, and the plasma generating device 120 generates an electromagnetic wave plasma in the cap 165. The active species containing gas sprays out from the outlet 166 of the cap 165 toward a flow line of the coating material sprayed from the spray gun 110. The coating material sprayed from the spray gun 110 spatters in the air and reaches an active species region 118 where the active species containing gas is present.

In the active species region 118, the coating material droplet collides with a charged particle such as an electron and an ion. In the coating material droplet, a part of the droplet brought into contact with the charged particle changes in chemical composition. The active species directly exerts a chemical action on the surface of the coating material droplet, and changes the surface of the coating material droplet in molecular composition. More particularly, the active species oxidize molecules on the surface of the coating material droplet. An organic solvent in the coating material droplet is softened (reduced in molecular weight). Generally, with respect to a hydrocarbon system solvent, as the molecular weight reduces, the intermolecular force weakens, and accordingly, the surface tension and the viscosity reduce. Furthermore, molecules on the surface of the coating material droplet are charged when the surface is brought into contact with a highly oxidative chemical species. As a result of this, the surface of the coating material droplet is polarized and changes in surface tension. Also, the surface of the coating material droplet reduces in surface tension by heating. Since, the reduction in surface tension of the coating material droplet is substantially equal to reduction in Weber number, a free surface becomes easily deformable, and the coating material droplet is atomized. The atomized coating material droplet passes through the active species region 118, and finally adheres to the target 116. Thus, a coat is formed on the target 116.

Effect of the First Embodiment

In the present embodiment, since the coating material droplet having reduced surface tension and viscosity is caused to adhere to the target 116, it becomes possible to improve adhesive property of the coating material droplet on the surface of the target 116. As a result thereof, since the droplets of coating material not adhering to the object are reduced in amount, the used amount of the coating material can be reduced.

Furthermore, in the present embodiment, since the coating material droplet atomized by the active species adheres to the surface of the target, it becomes possible to improve the finish of coating.

Here, a coating material spray apparatus of high pressure type, air atomizing type, or two-fluid nozzle type may cause defective atomizing due to the fact that, for example, the nozzle is clogged by coating material. For the purpose of avoiding such a situation, there is a case in which the coating material is diluted or spray pressure of the coating material is raised. However, since organic solvent is generally used for dilution of the coating material, emission level of volatile organic compounds will increase. Also, raising the spray pressure causes strong friction between the nozzle and the coating material, which could wear the nozzle and result in defective atomization.

On the other hand, according to the present embodiment, the coating material can be atomized without recourse to such remedies. Therefore, it is possible to avoid the problems accompanying high spray pressure and coating material dilution. According to the present embodiment, atomization of the coating material up to a target size is not exclusively required for the spray gun 110. Therefore, it is possible to reduce a usage of organic solvent for dilution. Since a diameter of a coating material outlet is not required to be small, it is possible to suppress the nozzle clogging. Also, since the spray pressure of the compressed air is not required to be high, it is possible to relax requirements in designing the spray gun itself.

Furthermore, in the present embodiment, since the coating material droplet on the moving path does not contact with the plasma, it becomes possible to prevent the coating material droplet from combustion.

First Modified Example

In the first modified example, the active species containing gas is supplied on the moving path of coating material droplets that does not contribute to coating. Such coating material droplets include droplets rebounded by the target 116, droplets blown away in the vicinity of the target 116, and droplets that drips from the spray gun 110.

Figure 4:
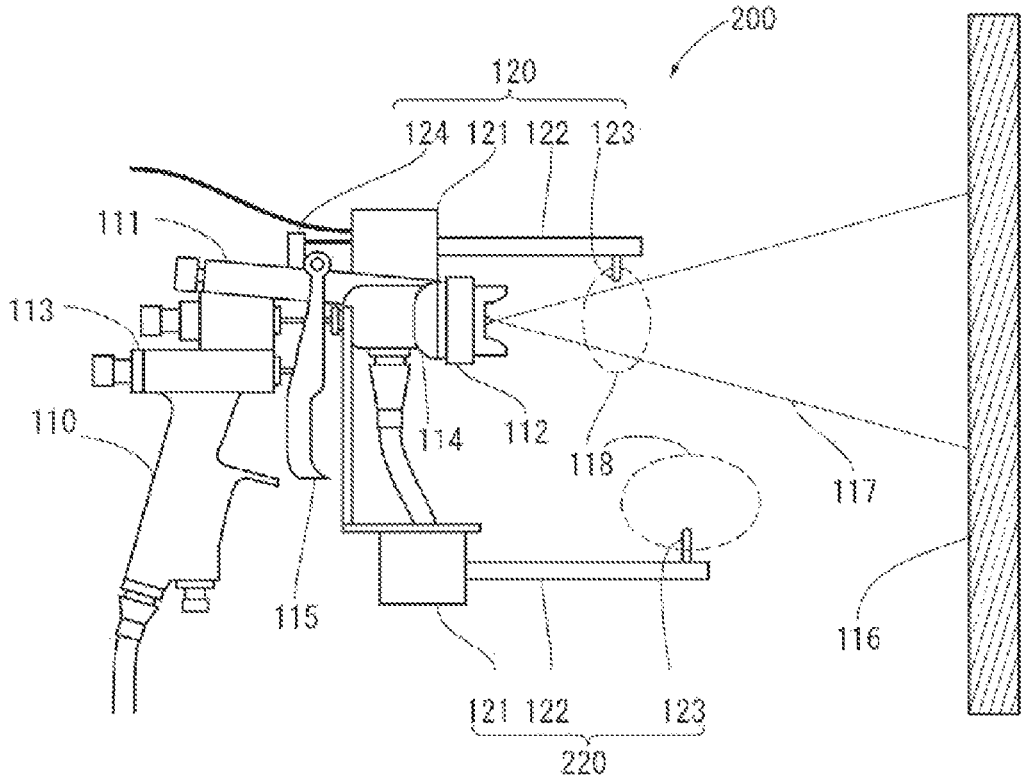
FIG. 4 is a schematic configuration diagram of a coating apparatus according to a first modified example of the first embodiment.

As shown in FIG. 4, the coating apparatus 200 is configured such that an auxiliary plasma generating device 220 is added to the coating apparatus 100 shown in FIG. 1. The plasma generating device 120 constitutes a first supply part that supplies an active species to be brought into contact with a droplet moving from the spray gun 110 toward the target 116, and the auxiliary plasma generating device 220 constitutes a second supply part that causes an active species to be brought into contact with a droplet that has been rebounded by the target 116.

The plasma generating device 120 includes the power supply device 121, the arm 122, and the discharge electrode part 123, each thereof is the same as the first embodiment described above. In the coating apparatus 200, the auxiliary plasma generating device 220 is arranged vertically beneath the nozzle 112 of the spray gun 110. The auxiliary plasma generating device 220 supplies the active species containing gas on the moving path of the coating material droplets that have rebounded from the target 116 or left the target 116 due to effects of airflow. By way of such active species containing gas, the coating material droplet that falls without adhering to the target 116 is oxidized.

In such processing of the coating material droplet, the entire coating material droplets may be vaporized and cleaned up, or the solvent may be selectively vaporized so that the remaining pigment composition may be solidified to fall through. In each case, it is possible to collect environmental pollutant in the solvent in an easy manner.

The auxiliary plasma generating device 220 may be separately from the spray gun 110, and may be arranged on a wall of a coating booth, on a ceiling, on a floor, or the like.

Second Modified Example

In the second modified example, unlike the first modified example, the auxiliary plasma generating device 220 supplies the active species to a VOC gas generated from the vaporized coating material droplet. The auxiliary plasma generating device 220 supplies the active species to an area of high concentration of VOC gas, more particularly, in the vicinity of an area of the target 116 where the droplet has adhered. The auxiliary plasma generating device 220 supplies the active species containing gas to the surface of the target 116 after the coating material has adhered to the target 116. The auxiliary plasma generating device 220 is moved in a manner so as to follow a trajectory of coated partial area on the surface of the target 116, thereby the active species containing gas is changed in destination. In the second modified example, since the active species is supplied to an area of high concentration of toxic component, it becomes possible to dissolve the toxic component with high energy efficiency.

Furthermore, it is possible for the auxiliary plasma generating device 220 to rapidly dry out the surface of the target 116 to dissolve and clean up a highly concentrated solvent component vaporized by the drying-out.

Third Modified Example

In the third modified example, unlike the first modified example, the auxiliary plasma generating device 220 causes the active species to be brought into contact with the surface of the target 116 before the droplet brought into contact with the active species is adhered to the target 116. The active species containing gas is supplied prior to arrival of the coating material droplet. According to the third modified example, it is possible to reform the surface of the target 116, thereby further improving adhesive property of the coating material.

Second Embodiment

The second embodiment is directed to a coating apparatus 30 configured by the coat forming apparatus 100 according to the present invention. The coating apparatus 30 is used for coating of a surface of polycarbonate resin, for example.

Figure 5:
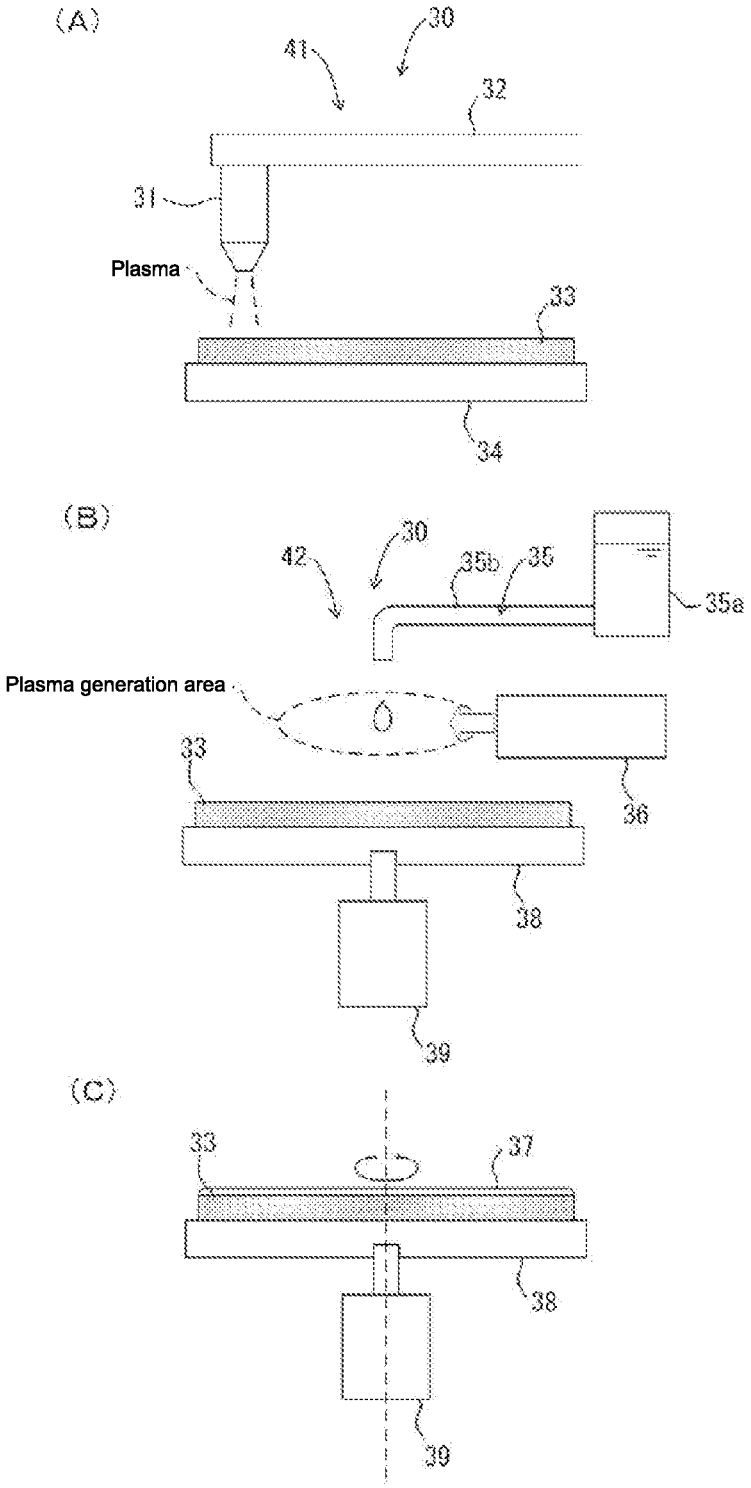

As shown in FIG. 5, the coating apparatus 30 is provided with a preprocessing part 41 and a coating part 42. The coating apparatus 30 is configured such that, after the preprocessing part 41 performs surface reforming using plasma on the surface of a substrate 33, the coating part 42 forms a coating layer (coat) 37 on the surface of the substrate 33.

As shown in FIG. 5A, the preprocessing part 41 is provided with a plasma spray device 31, a drive arm 32, and a platform 34. The plasma spray device 31 is, for example, a plasma torch. The plasma spray device 31 is supported by the drive arm 32. In the preprocessing part 41, the substrate 33 is put on the platform 34, and the plasma spray device 31 spraying plasma is moved by the drive arm 32. The drive arm 32 moves the plasma spray device 31 in a zigzag manner so that plasma processing may be performed on the entire surface of the substrate 33. The preprocessing part 41 reforms the entire surface of the substrate 33 by way of the plasma processing.

As shown in FIG. 5B, the coating part 42 is provided with a coating material dropper 35, a droplet processor 36, a rotation table 38, and a motor 39. The coating material dropper 35 is provided with a reservoir 35*a* that stores coating material, and a connector pipe 35*b* connected at an input end thereof to the reservoir 35*a*. An output end of the connector pipe 35*b* is located above the rotation table 38 of a disk shape. The coating material dropper 35 causes a coating material droplet in the reservoir 35*a* to fall on the rotation table 38. The droplet processor 36 is configured by a plasma generating device. The droplet processor 36 forms a non-equilibrium plasma beneath the output end of the connector pipe 35*b*. As shown in FIG. 5C, the droplet processor 36 reforms a coating material droplet that has fallen from the output end of the connector pipe 35*b* before the coating material droplet reaches the rotation table 38. The motor 39 rotates the rotation table 38 after the reformed droplet reaches the substrate 33 on the rotation table 38. As a result thereof, the droplet spreads out to form the coating layer 37.

In the second embodiment, the droplet processor 36 may generate plasma inside and supply an active species containing gas to an area where the droplet passes through. In this case, the droplet does not contact the plasma.

Effect of the Second Embodiment

In the present embodiment, a droplet having reduced surface tension and viscosity by an active species adheres to the surface of the substrate 33 (target) which has improved in hydrophilic property by the active species. Therefore, it becomes possible to further improve adhesive property of the droplet to the surface of the substrate 33.

Third Embodiment

The third embodiment is directed to a coating apparatus 50 including a plasma generating device 70 that reforms a coating surface of a film material 49. The coating apparatus 50 causes the plasma generating device 70 to reform the coating surface of the film material 49 at a specific position, causes the coating material to adhere to the coating surface exclusively at the specific position, thereby forming on the surface of the film material 49 a coating layer of arbitrary shape such as a figure, a character, and the like.

Figure 6:
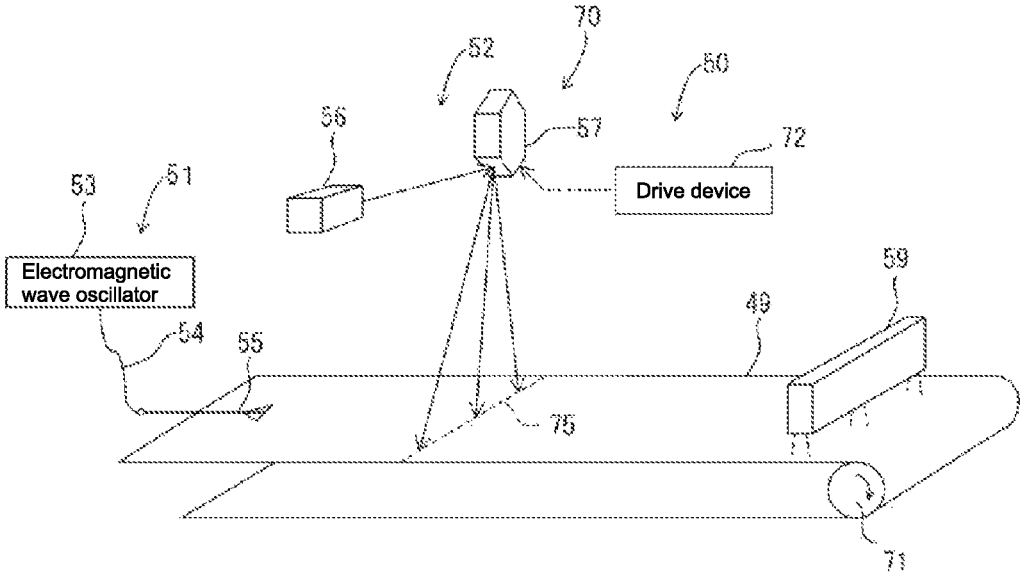
FIG. 6 is a schematic configuration diagram of a coating apparatus according to a third embodiment.

As shown in FIG. 6, the coating apparatus 50 is provided with a plasma generating device 70 that is able to generate plasma at an arbitrary position on the coating surface (top surface, in FIG. 6) of the film material 49, and a coating material supply device 59 that supplies the coating material to the top surface of the film material 49 so as to adhere the coating material to the top surface at a position where the plasma generating device 70 has performed surface reforming.

The plasma generating device 70 is provided with a laser radiation mechanism 52 that is able to adjust a laser irradiation position on the top surface of the film material 49, and an electromagnetic wave radiation mechanism 51 that relatively enhances electric field strength at a position irradiated with a laser by the laser radiation mechanism 52 on the top surface of the film material 49. While the laser radiation mechanism 52 is radiating a laser, the electromagnetic wave radiation mechanism 51 radiates an electromagnetic wave to the film material 49 so that the electric field strength becomes relatively high at the laser irradiation position on the top surface of the film material 49.

The laser radiation mechanism 52 is provided with a laser oscillator 56 that oscillates a laser, a rotating mirror 57 that adjusts a reflection direction of the laser outputted from the laser oscillator 56, a condensing optical system (not shown) that is arranged at a pass point of a laser reflected by the rotating mirror 57, and a drive device 72 for drive control of the rotating mirror 57. While the laser oscillator 56 is oscillating the laser, the laser radiation mechanism 52 drives via the drive device 72 the rotating mirror 57 to rotate, thereby changing the laser irradiation position on the top surface of the film material 49. Then, the condensing optical system condenses the laser on the top surface of the film material 49.

The rotating mirror 57 constitutes a reflection mechanism that reflects a laser oscillated by the laser oscillator 56 so that a predetermined target is irradiated with the laser. In the third embodiment, the rotating mirror 57 is a polygon mirror 57, and the condensing optical system is an F-Theta lens composed of spherical lenses and toroidal lenses. The film material 49 is formed in a strip shape. The film material 49 is wound around a roll member 71. As the roll member 71 rotates, the top surface of the film material 49 moves toward a coating material supply device 59. The top surface of the film material 49 moves in a rolling (longitudinal) direction of the roll member 71. The laser radiation mechanism 52 is able to irradiate anywhere on a line 75 (hereinafter, referred to as "laser irradiation line") along a width direction of the film material 49 that perpendicularly cross a moving direction of the film material 49 at a specific position. The laser radiation mechanism 52 is able to adjust the laser irradiation position along the width direction on the top surface of the film material 49.

In the laser radiation mechanism 52, a tilt of the polygon mirror 57 may be adjustable. As a result thereof, not only a position on the laser irradiation line 75, but also any position within a band along the laser irradiation line 75 can be irradiated with the laser.

The electromagnetic wave radiation mechanism 51 relatively enhances electric field strength at an area (on the laser irradiation line 75, in the third embodiment) where the laser radiation mechanism 51 can irradiate with the laser on the top surface of the film material 49. The electromagnetic wave radiation mechanism 51 is provided with an electromagnetic wave oscillator (for example, a magnetron) 53 that oscillates an electromagnetic wave, an antenna 55 that radiates the electromagnetic wave supplied from the electromagnetic wave oscillator 53. The antenna 55 is connected to the electromagnetic wave oscillator 53 via a coaxial cable 54. When an electromagnetic wave is radiated from the antenna 55, a strong electric field is formed on the laser irradiation line 75 and in the vicinity thereof. For example, the antenna 55 is arranged so that the top surface of the film material 49 is irradiated with the radiated electromagnetic wave.

The antenna 55 may be arranged beneath the laser irradiation line 75 on the film material 49. The antenna 55 may be of a shape (for example, zigzag shape) such that the electric field strength may be uniformly generated in a strong electric field area. In the following, a description will be given of the operation of the coating apparatus 50.

The coating apparatus 50, while rotating the roll member 71 and moving the film material 49, causes the laser radiation mechanism 52, the electromagnetic wave radiation mechanism 51, and the coating material supply device 59 to operate. The laser radiation mechanism 52 changes the laser irradiation position on the laser irradiation line 75 in accordance with a predetermined pattern. Since a strong electric field has been already formed on the laser irradiation line 75 by the operation of the electromagnetic mechanism 51, plasma is formed at the laser irradiation position. The laser radiation mechanism 52 changes the laser irradiation position on the top surface of the film material 49, thereby changing a position of plasma generated at the laser irradiation position. The film material 49 is reformed and improved in hydrophilic property and adhesive property at the laser irradiation position (plasma generation position). Accordingly, the coating material sprayed out from the coating material supply device 59 adheres to the top surface of the film material 49 exclusively at the reformed position. As a result thereof, a coating layer is formed in a shape of the predetermined pattern.

Rather than the top surface of the film material 49, the coating material itself may be reformed in a manner such that the coating material sprayed out from the coating material supply device 59 is brought into contact with the active species before the coating material arrives at the top surface of the film material 49.

The electromagnetic wave radiation mechanism 51 may be configured to change a property such as frequency, phase, and amplitude of the radiating electromagnetic wave in accordance with the laser irradiation position on the top surface of the film material 49. The electromagnetic wave radiation mechanism 51 changes the property of the radiating electromagnetic wave so that, for example, the electric field strength at the laser irradiation position may be uniform.

A resonant vessel that is internally formed with a resonant cavity that resonates the electromagnetic wave may be provided so as to cover the laser irradiation line 75 on the film material 49. The antenna 55 is arranged in the resonant vessel. The resonant vessel is formed so that a standing wave (electromagnetic wave) may have an antinode thereof on the laser irradiation line 75. Furthermore, the resonant vessel is formed with a slit so that the laser may be incident along the laser irradiation line 75.

Other Embodiments

In the embodiments and modified examples described above, though the plasma has been described to be generated by way of a method using a high voltage pulse and an electromagnetic wave in combination, the plasma may be generated by way of different methods. For example, instead of discharging by the high voltage pulse, laser induced breakdown or thermoelectron emission from a heated filament or the like may be used for plasma generation. Alternatively, a high voltage pulse and an electromagnetic wave may be mixed and supplied to the cathode 161. In this case, the cathode 161 functions as an antenna for electromagnetic wave radiation. Other methods such as dielectric-barrier discharge, creeping discharge, streamer discharge, corona discharge, arc discharge, and the like may be employed as the method of plasma generation.

Furthermore, in the embodiments and modified examples described above, though the coating material has been described to be sprayed by the spray gun 110 of air-atomizing type, a coating material spray device of a different type such as a high pressure type, two-fluid nozzle type, or rotary atomizing type for electrostatic coating may be employed in place of the spray gun. In case of the electrostatic coating, electric field distribution may well be distorted by plasma influence. However, in the embodiments described above, as long as the plasma is generated in the cap, the distortion in electric field distribution will be small.

INDUSTRIAL APPLICABILITY

The present invention is useful in relation to a coat forming apparatus that forms a coat such as a paint coat on a surface of a target.

EXPLANATION OF REFERENCE NUMERALS

100 Coating apparatus (coat forming apparatus)
110 Spray gun (droplet supply unit)
120 Plasma generating device (active species supply unit)
161 Target (object)

The invention claimed is:

1. A coating system, comprising:

(a) a spray gun that sprays a liquid droplet toward an object in such a manner that the spray gun provides a sprayed liquid droplet which moves outside the spray gun toward the object in one direction of a path of the sprayed liquid droplet toward the object; and (b) a plasma generating device comprising arm and a discharge electrode part at one end of the arm, the discharge electrode part comprising discharge electrodes and a cap with an outlet at one end of the discharge electrode part and said discharge electrode is configured to generate a plasma, said plasma generates an active species in a gas containing the active species inside the cap, the outlet of the cap facing perpendicular to a path of the sprayed liquid droplet such that the gas containing the active species is supplied from the outlet toward the path of the sprayed liquid droplet thereby bringing the gas containing the active species into contact with the sprayed liquid droplet outside of the spray gun such that the active species reduces a surface tension and viscosity of the sprayed liquid droplet; wherein (c) the plasma generating device is located between the spray gun and the object in the one direction of the path of the sprayed liquid droplet toward the object but outside of the path of the sprayed liquid droplet such that the plasma is generated outside of the path of the sprayed liquid droplet and the gas containing the active species is brought into contact with the sprayed liquid droplet outside the spray gun, and (d) the gas containing the active species comprises an oxygen radical, a hydroxyl radical or a reactive ion generated by the plasma.

2. The system, as set forth in claim 1, wherein the plasma generating device further comprising:

a) an inlet for introducing an outside gas from an outside of the cap into the cap in which the plasma reacts with the gas from the outside, thereby generating the gas containing the active species; and b) a controller programmed to close the inlet while an electromagnetic wave is emitted from the electromagnetic wave emitter.

3. The system, as set forth in claim 1, wherein the plasma generating device further comprising:

a) an inlet for introducing an outside gas from an outside of the cap into the cap in which the plasma reacts with the gas from the outside, thereby generating the gas containing the active species; and b) a controller programmed to control an amplitude of the electromagnetic wave emitted from the electromagnetic wave emitter based on whether or not the droplet contains a flammable material.

* * * * *